United States Patent [19]

Cabrera et al.

[11] Patent Number: 4,756,687

[45] Date of Patent: Jul. 12, 1988

[54] ROLL FUSER JAM CLEARANCE MECHANISM

[75] Inventors: Charles Cabrera, Longmont; Reid W. Gunnell, Berthoud; Glenn E. Siemer, Boulder; Eugene G. Stahlberg, Longmont, all of Colo.

[73] Assignee: International Business Machines Corporation, Armonk, N.Y.

[21] Appl. No.: 14,745

[22] Filed: Feb. 13, 1987

[51] Int. Cl.[4] ..... F27B 9/28

[52] U.S. Cl. ..... 432/60; 219/216; 219/469; 355/3 FU; 432/228

[58] Field of Search ..... 432/60, 228; 219/216, 219/469; 355/3 R, 3 FU

[56] References Cited

U.S. PATENT DOCUMENTS

| | | | |
|---|---|---|---|
| 4,110,068 | 8/1978 | Brown et al. | 432/60 |
| 4,145,181 | 3/1979 | Edwards et al. | 432/60 |
| 4,154,575 | 5/1979 | Edwards et al. | 432/60 |
| 4,363,549 | 12/1982 | Brown et al. | 355/3 FU |
| 4,421,401 | 12/1983 | Kagiura et al. | 355/3 FU |
| 4,428,660 | 1/1984 | Matsumoto | 355/3 FU |
| 4,429,987 | 2/1984 | Chang et al. | 355/3 FU |
| 4,475,804 | 10/1984 | Kanno et al. | 355/3 FU |
| 4,498,757 | 2/1985 | Lance et al. | 355/3 FU |
| 4,531,823 | 7/1985 | Deguchi et al. | 355/3 R |
| 4,589,758 | 5/1986 | Kasama et al. | 355/3 FU |

*Primary Examiner*—Steven E. Warner
*Attorney, Agent, or Firm*—Francis A. Sirr

[57] ABSTRACT

An electrophotographic hot roll fuser is manually movable from an operative position within an electrophotographic reproduction device, to an inoperative position where the fuser is available for cleaning, inspection or sheet jam clearance. When the fuser is in its inoperative position, a manually operable handle is accessible for operation. Operation of this handle moves various operating components, such as sheet guides, apart, thereby facilitating manual sheet jam clearance. Subsequently, when the handle is manually returned to its original position, all sheet guides and like components are accurately relocated to their original operative positions.

24 Claims, 6 Drawing Sheets

ROLL FUSER JAM CLEARANCE MECHANISM

FIELD OF THE INVENTION

This invention relates to electrophotography, and to the electrophotographic process step of fusing or fixing a toner image to the surface of a substrate medium such as a sheet of paper, as the medium passes through a pressure nip which is formed by engagement of two circular cylinder rolls or rollers.

BACKGROUND OF THE INVENTION

The well known electrophotographic reproduction process, as practiced in a copier or a printer, involves the toning of an electrostatic latent image with toner powder. This toner image is then transferred to a substrate medium, for example, paper in sheet or fanfold form. This substrate's toner image must now be fused or fixed to the substrate surface in order to form a permanent image thereon.

A well known fuser construction and arrangement provides two circular cylinder rolls, for example, about 3 inches in diameter and about 16 inches in axial length. These rolls are in pressure contact, and form an elongated fusing nip through which the sheet passes. Prior art devices of this type have used rolls that are unheated (i.e., cold roll pressure fusing), as well as one or both of the rolls heated (i.e., hot roll pressure fusing).

These two rolls are preferably covered with a material which is abherent to the toner being fused.

In addition, one or both of the rolls may be covered with an elastomer, and a silicone release oil may be applied to the elastomer surface by the use of a wick or the like.

While present day roll fusers are for the most part reliable devices, the possibility of a sheet of paper jamming as it is passing through the fuser has not been completely eliminated, and means must be provided to allow manual jam clearance to occur in a convenient, safe and simple manner.

This problem has been addressed in the art, and U.S. Pat. Nos. 4,421,401; 4,428,660; 4,475,804; 4,498,757; 4,531,823 and 4,589,758 are exemplary of prior arrangements.

A more highly developed fuser jam clearance mechanism is shown in U.S. Pat. No. 4,110,068. In this patent, a manually operable handle is provided so that the operator can open the fuser, exposing the fuser's sheet path, thus allowing a jammed sheet to be removed.

The present invention is an improvement upon these prior devices, in that fewer parts (i.e., lower cost) are required to provide reliable operation.

SUMMARY OF THE INVENTION

The present invention provides a roll fuser having two circular cylinder rolls that are mounted to rotate on parallel horizontal axes. The two roll axes are generally vertically located, one above the other, and the axes lie in a plane that is only somewhat inclined to the vertical direction. In this way, the fusing nip formed by the two rolls is conveniently located to accept a sheet as the sheet travels in a generally horizontal plane.

As the sheet exits the fusing nip, the sheet's leading edge encounters sheet guide means. These guide means not only aid in the release of the sheet's leading edge from the surface of the rolls, but also guide the sheet as the sheet moves on to driving rollers that move the sheet to further processing stations contained within the reproduction device.

The fuser of the present invention is mounted on horizontally extending slide rails. These rails enable manual movement of the fuser from an operative position, within the reproduction device, to an inoperative position. In the inoperative position, the fuser is located outside of the reproduction device, where it is available for inspection, service and the like.

If a sheet jam should occur as a sheet attempts to pass through the fuser, the operator first moves the fuser to its inoperative position. In this position, all electrical supply to the fuser is disconnected.

A distinctively colored, manually operable handle (whose distinctive color is associated with manual jam clearance mechanisms throughout the reproduction device) is now accessible to the operator. Upward arcuate movement of this handle (clockwise in the embodiments shown), about 120°, separates the fuser's exit sheet guides and the like, so that the fuser's sheet path is open for inspection and manual access. Delicate and sharp sheet guides that aid in the release of the sheet's leading edge from the roll surfaces are also moved to positions where they will not be damaged, and where the operator's hand will not be cut during jam clearance. In this position of the fuser mechanism, the fuser's mechanical members have been moved to a stable location where, when the handle is released, the members remain under the force of gravity.

The operator now clears the sheet jam, whereupon the handle is returned to its original position. In this original position the fuser's mechanical parts are again stable, as they are held by the force of gravity. However, in the preferred embodiment of the present invention, a spring catch is provided to aid in holding the fuser's mechanical parts in the operating position.

The foregoing and other objects, features and advantages of the invention will be apparent from the following more particular description of the preferred embodiments of the invention, as illustrated in the accompanying drawing.

THE INVENTION

Figure 1:
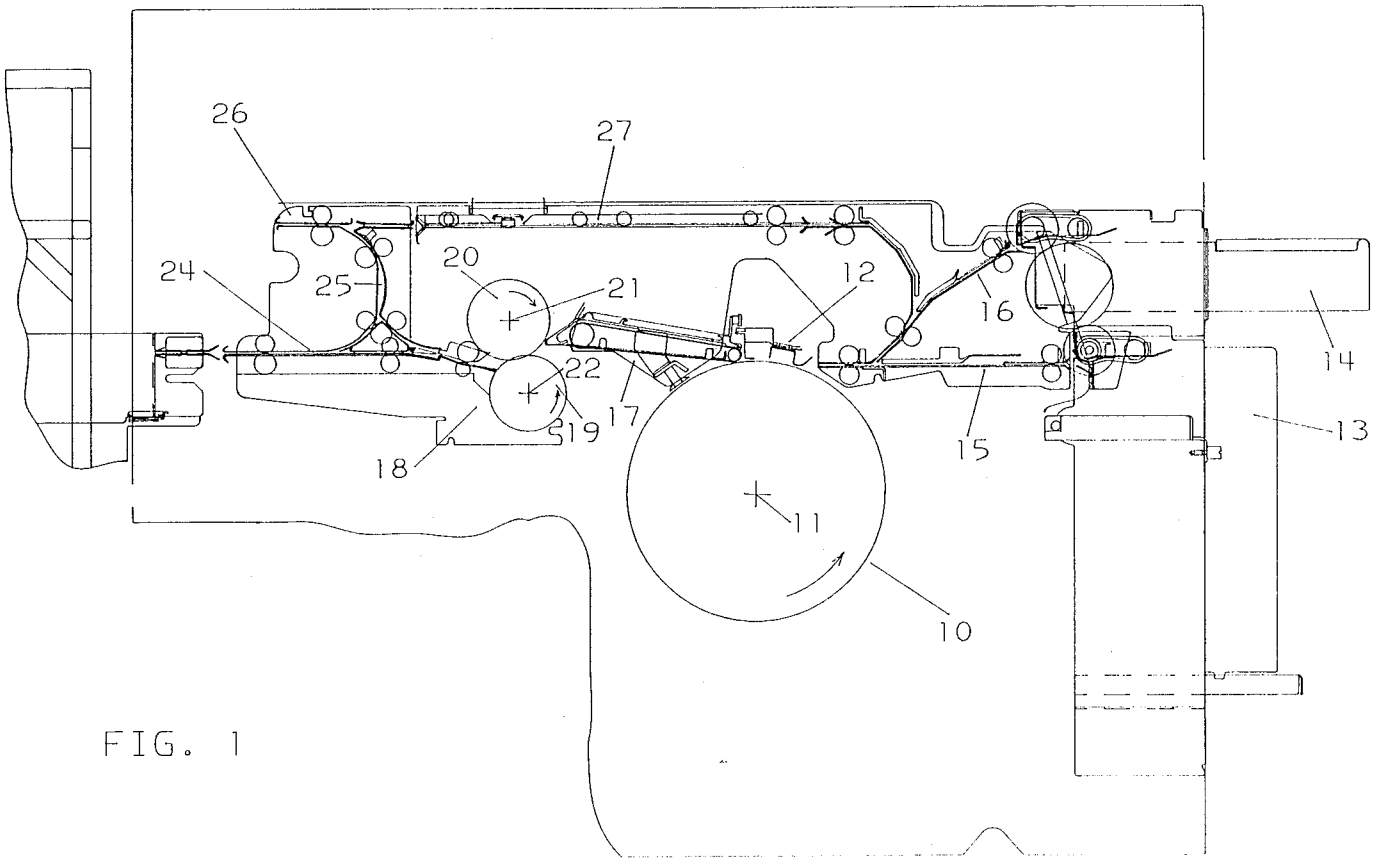
FIG. 1 is a front side schematic view of a xerographic reproduction device including the present invention.

FIG. 1 is a front schematic view of an electrophotographic device which includes the fuser of the present invention. Only a portion of the reproduction device is shown. Photoconductor drum 10 (about 11 inches in diameter and 16 inches in axial length) rotates counterclockwise, at a constant speed, about axis 11. Various xerographic means, such as a charging station, an imaging station, a developing station and a cleaning station are not shown. As is well known in the art, operation of these various stations results in the photoconductor carrying a toner image to transfer station 12.

A sheet of paper is fed to transfer station 12 from a selected one of two cut sheet paper supply bins 13 or 14, by way of paper guide paths 15 and 16, respectively. While not critical, the paper in this device is fed with a long edge as the sheet's leading edge. That is, for a sheet of 8½-inch by 11-inch dimension, the sheet's 11-inch edge is the leading edge.

A vacuum transport belt assembly 17 is provided to move the sheet from transfer station 12 to hot roll fusing station 18. The unfused toner is carried on the sheet's bottom surface. Fuser rolls 19 and 20 are driven to rotate about parallel axes 22 and 21. The surface speed of the rolls is about 9½ inches per second, whereas the speed at which the sheet is being driven from right to left by belt transport 17 is about 22 inches per second. Until the sheet's trailing edge has been released from the fusing nip, the belts of transport 17 slip on the surface of the sheet.

Note that roll axis 21 is above and only somewhat to the left of roll axis 22. Rolls 19 and 20 are circular cylinder in shape and are about 3 inches in diameter and 16 inches in length. Roll 19 is a heated roll, whereas roll 20 is unheated.

As the leading edge of a sheet exits the elongated fusing nip provided by engagement of rolls 19 and 20, the sheet enters an assembly of sheet guides.

Figure 2:
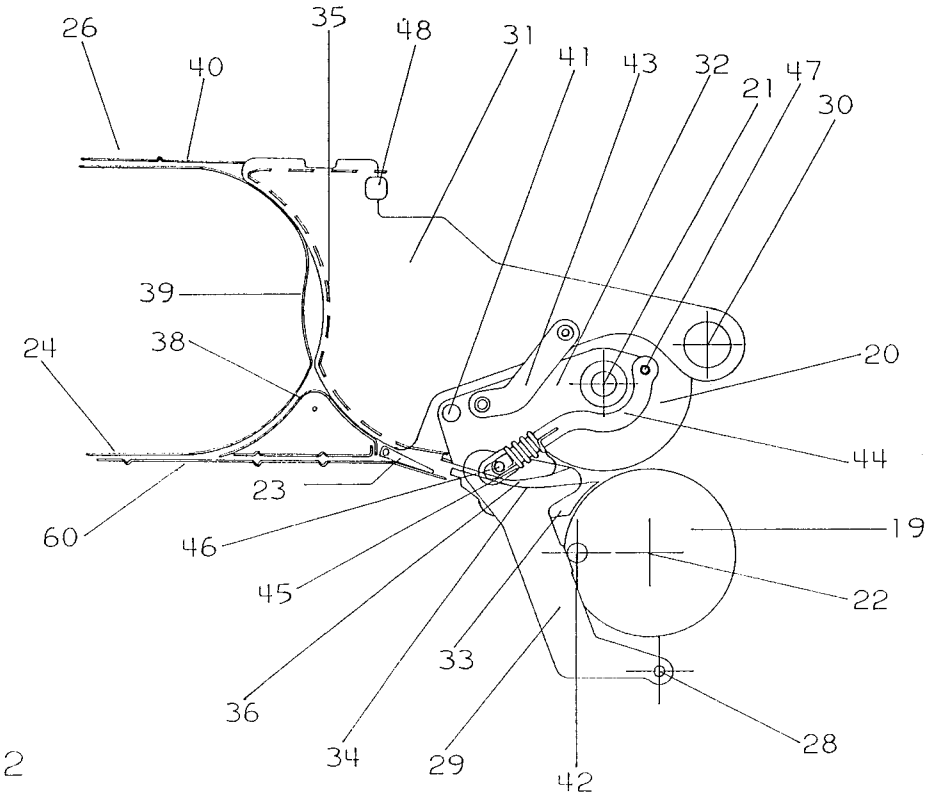
FIG. 2 is a front side view of the fuser of FIG. 1, showing a first embodiment of the present invention in the closed position.

A vane deflector 23 is selectively positioned to direct the sheet to exit sheet path 24 or to invertor sheet path 25 (path 25 is formed by members 35 and 39 of FIG. 2). When an image is to be placed on both sides of the sheet (i.e., duplex reproduction), sheet path 25 operates such that a sheet having an image fused to one side thereof is driven all of the way into invertor 26, such that the sheet's trailing edge leaves path 25. The sheet's direction is then reversed, and the sheet moves through sheet path 27 and back to transfer station 12. An image is now fused to the other side thereof. The sheet is now driven partially into invertor 26, the sheet's direction is reversed, and the sheet thereafter returns to path 24. This general use of a sheet invertor is well known in the art.

The present invention relates to the construction and arrangement of the fuser and the sheet guide assembly, which construction and arrangement facilitates sheet jam clearance and the like.

FIG. 2 is a side view of a first embodiment of fuser 18 and the sheet guide assembly, showing the various parts thereof in their operative position.

Figure 3:
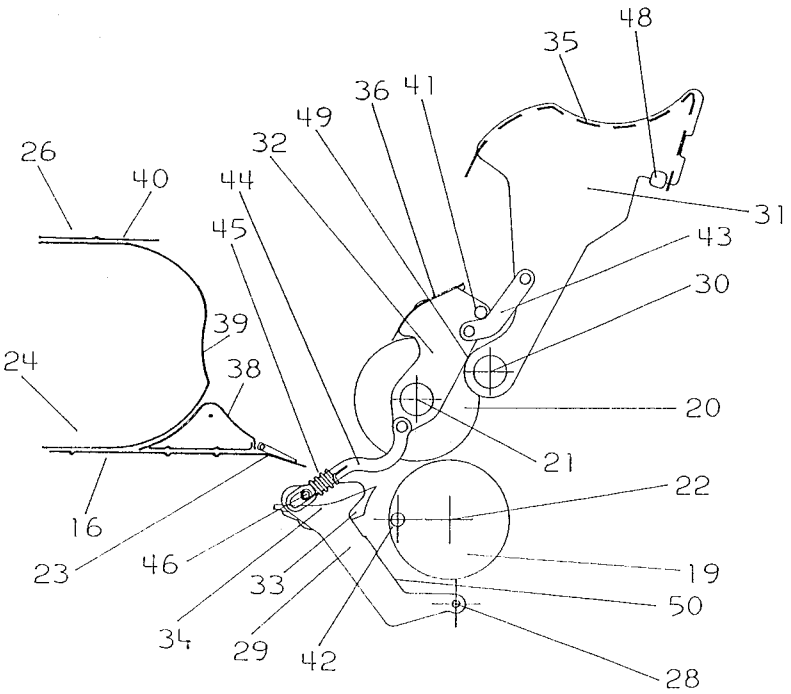
FIG. 3 is a front side view of the fuser of FIG. 2, but showing the fuser in the open position.

FIG. 3 is a view similar to FIG. 2, but shows the various parts in their inoperative position, to facilitate jam clearance, service, inspection and the like.

Only portions of the fuser are shown. For example, rolls 19 and 20 are mounted to a metal frame (not shown) that supports the rolls for rotation about axes 21 and 22. In addition, the axis 21 of roll 20 is capable of slight movement, to open the fusing nip. These details of fuser construction are not critical to the present invention, and reference can be had to U.S. Pat. No. 4,154,575 (incorporated herein by reference) for an exemplary showing of these and other fuser construction details.

For the purpose of relating the components shown in FIGS. 2 and 3 to the fuser's aforementioned metal frame, roll axis 22, the pivot point 28 of links 29 (two are provided, one at each axial end of the rolls), the pivot point 30 of links 31 (two are provided), and pins 42 (two are provided) are all connected to this frame.

In a preferred embodiment of the present invention, roll axis 21 was connected to the fuser's metal frame in a manner such that axis 21 was somewhat movable, to facilitate opening and closing of the fusing nip. This construction and arrangement is shown in above-mentioned U.S. Pat. No. 4,154,575.

Note that links 29 and 31 comprise flat metal plates, and that similar plates reside at the back side of the fuser assembly (FIGS. 2 and 3 being a front side view of the fuser assembly).

The two links 29 support an elongated metal sheet guide 33 that extends the length of the fusing nip. Guide 33 operates to guide the sheet's leading edge away from the surface of roll 19 and onto the upper surface 34 of the sheet guide.

Two flat metal plates 32, one of which is located adjacent each end of roll 20, are pivoted on the axis 21 of roll 20. These two plates mount an elongated metal sheet guide member 36 that also spans the entire length of the fusing nip. Guide member 36 functions to remove the sheet's leading edge from the surface of roll 20, and to guide the sheet into the sheet path which is formed by members 33 and 36. Each of the plates 32 mounts a short stop pin 41 which extends away from the surface of the plate, in a direction extending away from roll 20. These pins limit manual opening of the fuser assembly, as will be apparent.

The two links 31 support a sheet metal plate 35 which spans the length of the fusing nip. Plate 35 forms a right-hand surface that defines FIG. 1's sheet path 25.

An elongated, triangular shaped metal member 38, an elongated arcuate metal plate 39, and elongated flat metal plates 40 and 60 form the remaining portions of FIG. 1's sheet paths 24, 25 and 26.

Plates 31 at each end of the fusing nip are connected to links 32 by a metal link 43 that is pivotally mounted to each of these members. Likewise, links 32 are pivotally connected to links 29 by a metal link 44. The connection of link 44 to link 29 is by way of a spring 45 whose right-hand end is attached to link 44, and whose left-hand end encircles a pin 46 that extends upward from the surface of link 29. As a result, extension of the two coil springs 45 (one at each end of the fusing nip) allows the distance between pins 46 and pivot point 47 to increase in the event of a sheet jam between the surface of roll 19 and sheet guide 33.

An elongated, manually operable handle 48 extends between and connects the two plates 31. When the fuser assembly is moved to its inoperative position (as shown in FIG. 1 of aforementioned U.S. Pat. No. 4,154,575), handle 48 is available for operation by service personnel or by the reproduction device's operator.

When the operator grasps handle 48, and rotates plates 31 and plate 35 in a clockwise direction, the fuser's exit paper path opens as shown in FIG. 3. The extent of opening is limited by engagement of pins 41 to links 43, or alternatively, this opening can be limited by engagement of links 32 to plates 31, as is seen at 49.

In the open position of FIG. 3, the lower paper guide 33 has been moved away from the surface of roll 19 so that any paper that may have become caught beneath the lower paper guide and the roll can be removed. In addition, upper paper guide 36 has been moved upward to expose its under surface for paper removal.

Not shown in FIGS. 2 and 3 are paper drive rollers that are located in guide 36 and corresponding paper idler rollers that are mounted in paper guide 34. It can, however, be seen that when the mechanism is in the open position of FIG. 3, all of these paper drive means are opened for jam clearance. This arrangement facilitates jam clearance because no drive means grips the paper in this open position of the mechanism.

FIG. 3 also shows that spring 45 has pulled pin 46, and hence plate 29, as far to the right as the slot in links 44 will allow.

After the jam has been cleared, the operator grasps handle 48 and rotates the same counterclockwise to close the mechanism. Before the mechanism completely closes, the surfaces 50 of links 29 engage stationary pins 42. These pins prevent further clockwise rotation of links 29 about pivot points 28. This construction and arrangement provides consistent accurate location of the paper guides relative the surface of the fuser rolls at the exit of the fusing nip.

As counterclockwise rotation of handle 48 continues, the slots which are formed in the left-hand ends of links 44 slide relative the now stationary pins 46 which are carried by link 29. This relative movement of links 29 and links 44 causes coil springs 45 to extend. Thus, springs 45 resiliently force and hold links 29 clockwise against pins 42.

The benefit of this construction and arrangement is that paper guide 33 is movable away from the surface of hot roll 19 in the event that a large paper jam occurs between roll 19 and guide 33. This construction and arrangement greatly reduces the likelihood of damage to the soft elastomer surface of hot roll 19. Springs 45 are of sufficient strength, however, to accurately locate the sheet guides at the exit of the fusing nip.

Figure 4:
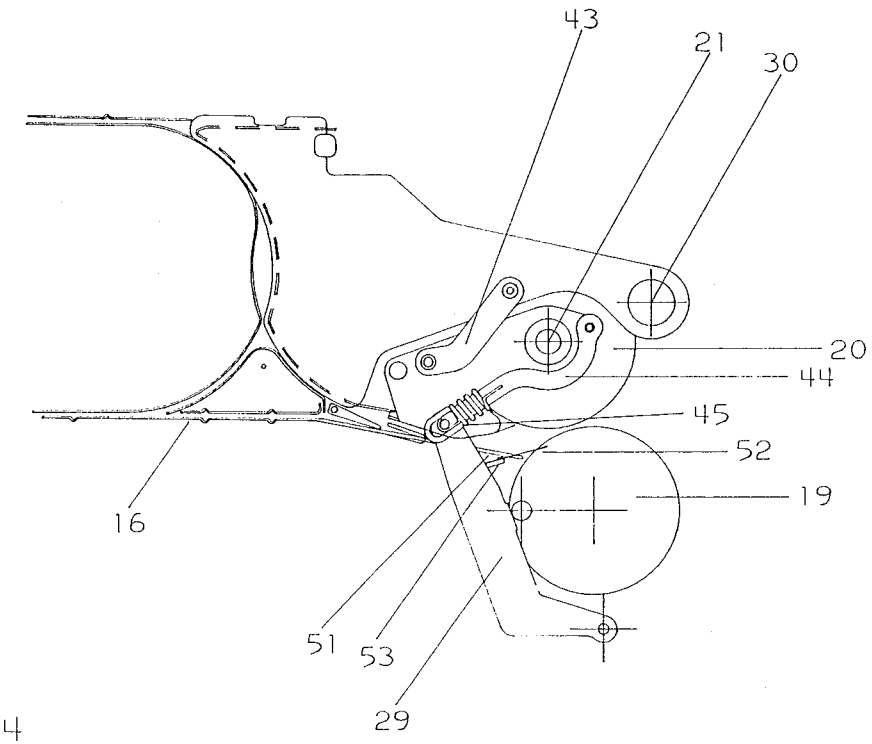
FIG. 4 is a front side view of a second embodiment of the present invention with the fuser in the closed position.
Figure 5:
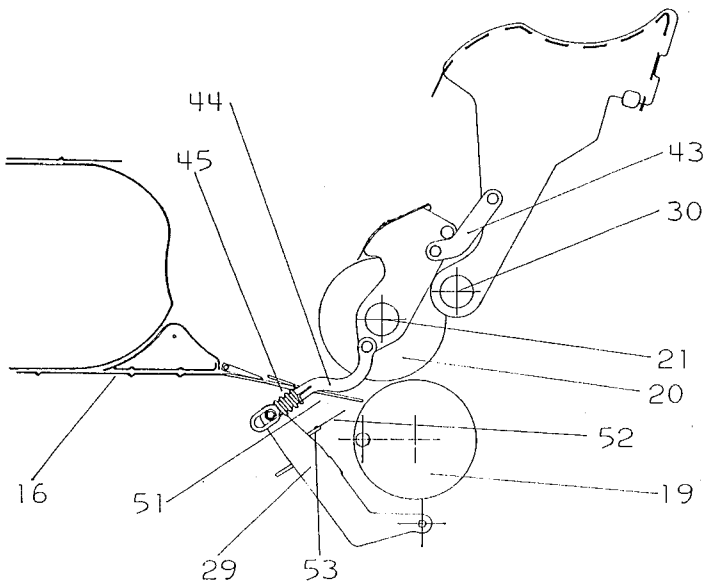
FIG. 5 is a front side view of the fuser of FIG. 4, but showing the fuser in the open position.

FIGS. 4 and 5 show a second embodiment of the present invention. In this embodiment, a stationary lower metal paper guide 51 is formed as an extension of member 16. Guide 51 is an elongated member which extends the length of the fusing nip, closely adjacent the surface of roll 19. The edge of guide 51 which is adjacent roll 19 is slotted so to receive a number of flexible, blade-like metal fingers 52. Fingers 52 are mounted on link 29 and are movable therewith as the mechanism is opened, see FIG. 5.

Fingers 52 ride on the surface of roll 19. They therefore tend to be honed to a razor sharp edge. As is seen in FIG. 5, when the mechanism is opened, these sharp fingers are retracted out of the way. Hence, there is no likelihood of damage either to fingers 52, or to the operator's hands during jam clearance.

Preferably, fingers 52 are mounted on a stiff metal backing plate 53 which protects fingers 52 from excessive bending in the event of a sheet jam between the fingers and the surface of roll 19.

Figure 6:
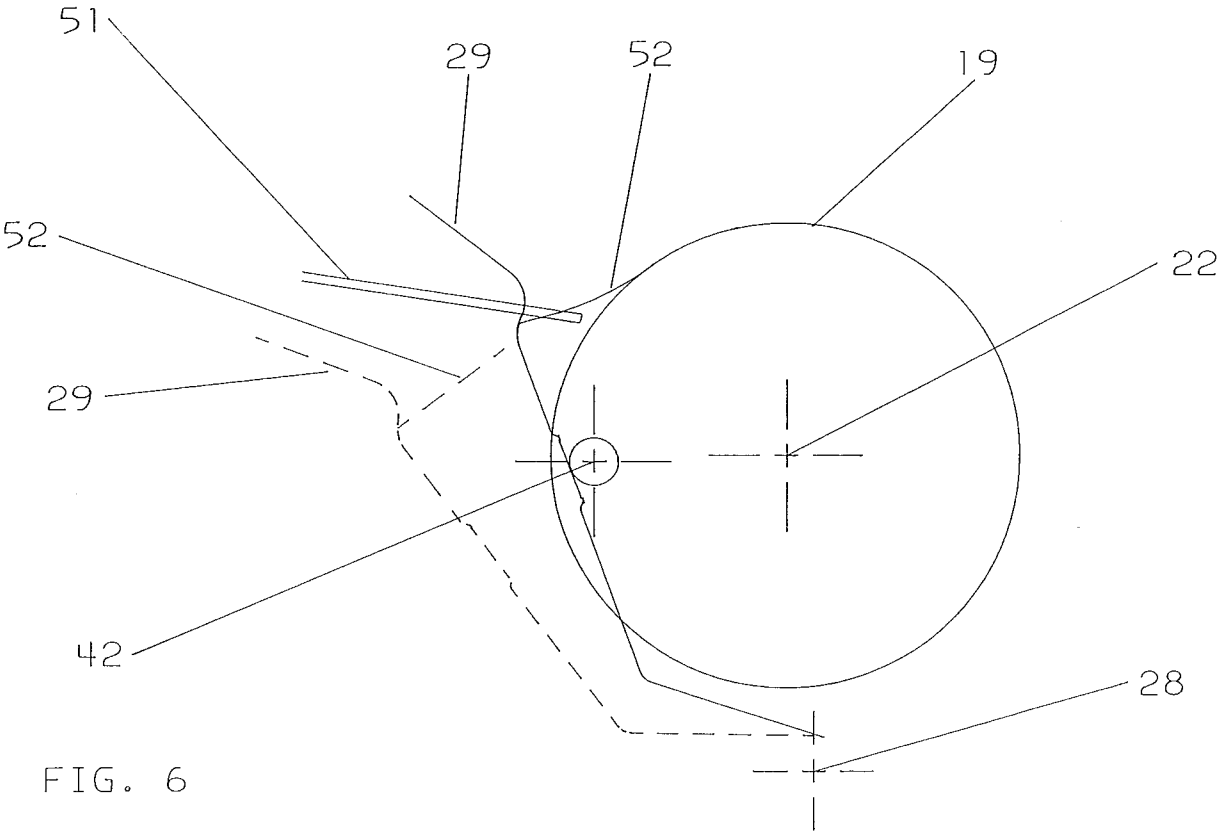
FIG. 6 is an enlarged view of a portion of the fuser shown in FIGS. 4 and 5, wherein the solid line shows the position of fingers 52 corresponding to FIG. 4, and the dotted line shows the position of fingers 52 corresponding to FIG. 5.

FIG. 6 is an enlarged view that shows in solid line the manner in which thin flexible metal fingers 52 engage the surface of roll 19, and are bent by this engagement. When the mechanism is opened, as is shown in FIG. 5, and as is shown in the dotted line position of FIG. 6, the sharp ends of fingers 52 are moved to a location below stationary paper guide 51. Thus the operator cannot accidentally touch these sharp ends during jam clearance and the like.

With reference to FIGS. 2 and 3, and FIGS. 4 and 5, it can be seen that the critical placement of the pivot points for links 43 and 44 allows the weight of the mechanism itself to lock the mechanism in a stable open position (FIGS. 3 and 5) and in a stable closed position (FIGS. 2 and 4), and that no latch means need be provided to hold the mechanism in either of these two positions. In a preferred embodiment of the present invention, a spring catch (not shown) was provided to aid in holding the mechanism in its closed position.

The critical location of these pivot points also protects the surface of roll 19, by allowing spring 45 to extend in the event that paper jams between the sheet guides which are carried by link 29 and the surface of roll 19.

An additional feature of the present invention is that when the mechanism is in its open position (FIGS. 3 and 5), the center of gravity of the open mechanism is to the right of pivot points 21 and 30. Thus, the force of gravity keeps the mechanism in a stable open position while the operator clears a sheet jam, or while the mechanism is serviced.

Likewise, when the mechanism is in its closed position (FIGS. 2 and 4), the center of gravity is to the left of these pivot points, and the force of gravity keeps the mechanism in a stable closed position.

While this invention has been particularly shown and described with reference to preferred embodiments thereof, it will be understood by those skilled in the art that various changes in form and detail may be made therein without departing from the spirit and scope of this invention.

What is claimed is:

1. A roll fuser assembly for use in fusing a toner image to the surface of sheet substrate, comprising:

a first and a second roll forming a toner fusing pressure nip, said rolls being rotatable on spaced axes;

first sheet guide means positioned closely adjacent the surface of said first roll at the exit side of said fusing nip;

second sheet guide means positioned closely adjacent the surface of said second roll at the exit side of said fusing nip;

said first and second sheet guide means normally being closely spaced to define a first normally closed sheet guide path which is located closely adjacent the downstream side of said fusing nip;

a first pivoted link member on which said first sheet guide means is mounted, said first link member being mounted to pivot about an axis that is spaced from the axis of rotation of said first roll;

a second pivoted link member on which said second sheet guide means is mounted, said second link member being mounted to rotate about an axis coincident with the axis of rotation of said second roll;

a drive link interconnecting said first and second link members, such that rotation of one of said link members in one direction produces opposite direction rotation of the other link member; and manually operable handle means connected to one of said link members, movement of said handle means in one direction being operable to produce concomitant opposite direction rotation of said first and second link members, so as to move said first and second sheet guide means apart, thereby facilitating sheet jam clearance from said first sheet guide path, and subsequent movement of said handle means in the opposite direction being operable to return said first and second guide means to said normal close spacing.

2. The roll fuser of claim 1 wherein said drive link includes spring means arranged to allow extension of said drive link, and thereby movement of at least one of said first and second sheet guide means as a result of the force exerted by a sheet jam as the sheet exits said fusing nip.

3. The roll fuser of claim 1 including a stationary paper guide plate extending closely adjacent the surface of said first roll at the exit side of said fusing nip, the edge of said paper guide plate that confronts said first roll surface having a series of slots formed therein, and wherein said first sheet guide means comprises a plurality of movable, flexible metal fingers that extend through said slots to engage and to be flexed by said first roll surface, said fingers being moved to a location below said paper guide plate upon movement of said handle means in said one direction.

4. The roll fuser of claim 1 including first stop means operable to limit movement of said handle means in said one direction to a stable position whereat the weight of said handle means maintains said first and second guide means in said apart position, and second stop means operable to limit movement of said handle means in said opposite direction to a stable position whereat the weight of said handle means maintains said first and second guide means in said close spacing.

5. The roll fuser of claim 4 wherein said drive link includes spring means arranged to allow extension of said drive link, and thereby movement of at least one of said first and second sheet guide means as a result of the force exerted by a sheet jam as the sheet exits said fusing nip.

6. The roll fuser of claim 1 including third sheet guide means mounted at the downstream side of said first sheet guide means, fourth sheet guide means mounted downstream of said second sheet guide means, said third and fourth sheet guide means normally being closely spaced to define a second normally closed sheet guide path which is operable to receive a sheet from said first sheet guide path, and said fourth sheet guide means being mounted on said handle means, such that manual movement of said handle means in said one direction moves said fourth sheet guide means away from said third sheet guide means, to thereby facilitate jam clearance from said second sheet guide path, and such that said opposite direction movement of said handle means returns said fourth sheet guide means to close spacing with said third sheet guide means.

7. The roll fuser of claim 6 wherein said drive link includes spring means arranged to allow extension of said drive link, and thereby movement of at least one of said first or second sheet guide means as a result of the force exerted by a sheet jam as the sheet exits said fusing nip.

8. The roll fuser of claim 6 including first stop means operable to limit movement of said handle means in said one direction to a stable position whereat the weight of said handle means maintains said first, second and fourth guide means in said apart position, and second stop means operable to limit movement of said handle means in said opposite direction to a stable position whereat the weight of said handle means maintains said first, second and fourth guide means in said close spacing.

9. The roll fuser of claim 8 wherein said drive link includes spring means arranged to allow extension of said drive link, and thereby movement of at least one of said first and second sheet guide means as a result of the force exerted by a sheet jam as the sheet exits said fusing nip.

10. A roll fuser for use in fusing toner to the surface of sheet substrate as the substrate moves in a sheet feed direction, the roll fuser comprising:

a first circular cylinder roll mounted to rotate on a first generally horizontal axis that extends generally perpendicular to said sheet feed direction;

a second circular cylinder roll mounted to rotate on a second generally horizontal axis that extends generally perpendicular to said sheet feed direction;

said first axis being arranged generally vertically below said second axis, and said first and second rolls being in surface contact to thereby form a pressure fusing nip through which said sheet passes while moving in said sheet feed direction;

first sheet guide means closely adjacent said first roll at the exit side of said fusing nip;

second sheet guide means closely adjacent said second roll at the exit side of said fusing nip;

said first and second sheet guide means normally being in a closely spaced position, to form a first closed sheet guide path which is operable to guide the leading edge of a sheet away from the exit side of said fusing nip;

first pivoted link means having one end portion to which said first sheet guide means is mounted, the other end portion of said first link means being pivoted to rotate about a third axis that is parallel to and is located generally vertically below said first axis;

second pivoted link means having one end portion to which said second sheet guide means in mounted, said second link means having a mid portion pivoted to rotate about said second axis, and having an opposite end portion which extends to the upstream side of said fusing nip; and a first drive link interconnecting said opposite end portion of said second link means to said first end portion of said first link means, such that rotation of said second link means in one direction moves said first and second sheet guide means apart to facilitate sheet jam clearance from said first sheet guide path, and subsequent opposite direction rotation of said second link means returns said first and second guide means to said closely spaced position.

11. The roll fuser of claim 10 including first stop means engageable by said second link means operable to limit said apart movement of said first and second sheet guide means; and second stop means engageable by said first link means operable to limit said return movement of said first and second sheet guide means.

12. The roll fuser of claim 10 including coil spring means associated with said first drive link, said coil spring means being operable to facilitate extension of said first drive link, and apart movement of said first and second sheet guide means in the event of the occurrence of a sheet jam in said first sheet guide path.

13. The roll fuser of claim 10 including a stationary paper guide plate extending closely adjacent the surface of said first roll at the exit side of said fusing nip, the edge of said paper guide plate that confronts said first roll surface having a series of slots formed therein, and wherein said first sheet guide means comprises a plurality of movable, flexible metal fingers that extend through said slots to engage and to be flexed by said first roll surface, said fingers being moved to a location below said paper guide plate upon rotation of said second link means in said one direction.

14. The roll fuser of claim 10 including third sheet guide means mounted adjacent said first sheet guide means, and on the opposite side thereof from the exit side of said fusing nip;

fourth sheet guide means adjacent said second sheet guide means, and on the opposite side thereof from the exit side of said fusing nip;

said third and fourth sheet guide means normally being in a closely spaced position, to form a second closed sheet guide path which is operable to guide the leading edge of a sheet away from the exit side of said first sheet guide path;

third pivoted link means having one end portion to which said fourth sheet guide means is mounted, the other end portion of said third link means being pivoted to rotate about a fourth axis that is parallel to and is located generally to the upstream side of said opposite end portion of said second pivoted link means, a second drive link interconnecting a mid portion of said third link means to said first end portion of said second link means, such that rotation of said second link means in one direction moves said first and second sheet guide means apart to facilitate sheet jam clearance from said first sheet guide path, and subsequent opposite direction rotation of said second link means returns said first and second guide means to said closely spaced position, a first drive link interconnecting said opposite end portion of said second link means to said one end portion of said first link means, such that rotation of said third link means in one direction produces rotation of said first link means in said one direction, and rotation of said second link means in an opposite direction, whereupon said first and second sheet guide means, and said third and fourth sheet guide means, move apart to facilitate sheet jam clearance from said first sheet guide path, and from said second sheet path, and subsequent opposite direction rotation of said third link means returns said first and second sheet guide means, and said third and fourth sheet guide means, to said closely spaced position.

15. The roll fuser of claim 14 including first stop means engageable by said second link means operable to limit said apart movement of said first and second sheet guide means; and second stop means engageable by said first link means operable to limit said return movement of said first and second sheet guide means.

16. The roll fuser of claim 14 including coil spring means associated with said first drive link, said coil spring means being operable to (1) locate said first and second sheet guide means at the exit side of said fusing nip, and to (2) facilitate extension of said first drive link, and thereby apart movement of said first and second sheet guide means, in the event of the occurrence of a sheet jam in said first sheet guide path.

17. The roll fuser of claim 14 wherein the center of gravity of said third link means is disposed to the upstream side of said fourth axis when said third link means is rotated in said one direction, to thereby maintain said first and second sheet guide means, and said third and fourth sheet guide means, in a stable apart position, to facilitate sheet jam clearance from said first sheet guide path, and from said second sheet path, and wherein the center of gravity of said third link means is disposed to the downstream side of said fusing nip when said third link means is rotated in said opposite direction, to thereby maintain said first and second sheet guide means, and said third and fourth sheet guide means, in a stable closed position.

18. The roll fuser of claim 17 including first stop means engageable by said second link means operable to limit said apart movement of said first and second sheet guide means; and second stop means engageable by said first link means operable to limit said return movement of said first and second sheet guide means.

19. The roll fuser of claim 17 including coil spring means associated with said first drive link, said coil spring means being operable to facilitate extension of said first drive link, and apart movement of said first and second sheet guide means in the event of the occurrence of a sheet jam in said first sheet guide path.

20. A roll fuser for use in fusing toner to the surface of sheet substrate as the substrate moves in a sheet feed direction, the roll fuser comprising:

a first circular cylinder roll mounted to rotate on a first generally horizontal axis that extends generally perpendicular to said sheet feed direction;

a second circular cylinder roll mounted to rotate on a second generally horizontal axis that extends generally perpendicular to said sheet feed direction;

said first axis being arranged generally vertically below said second axis, and said first and second rolls being in surface contact, to thereby form a pressure fusing nip through which said sheet passes while said sheet moves in said sheet feed direction, said sheet approaching said fusing nip from the upstream side of the nip, and leaving said fusing nip from the downstream side thereof;

first sheet guide means closely adjacent said first roll at the downstream side of said fusing nip;

second sheet guide means closely adjacent said second roll at the downstream side of said fusing nip;

said first and second sheet guide means normally being in a closely spaced position, to form a first closed sheet guide path which is operable to guide the leading edge of a sheet away from the downstream side of said fusing nip; and manually operable handle means movably mounted above said fusing nip and connected to said first and second sheet guide means, said handle means being movable between a first stable position where the center of gravity of said handle means is disposed to the downstream side of said fusing nip, and said first and second sheet guide means are in said closely spaced position, and a second stable position where the center of gravity of said handle means is disposed to the upstream side of said fusing nip, and said first and second sheet guide means are spaced apart to facilitate sheet jam clearance from said first sheet guide path.

21. The roll fuser of claim 20 including first stop means operable to limit said close spacing of said first and second sheet guide means; and second stop means operable to limit said spaced apart movement of said first and second sheet guide means.

22. The roll fuser of claim 20 including a stationary paper guide plate extending closely adjacent the surface of said first roll at the exit side of said fusing nip, the edge of said paper guide plate that confronts said first roll surface having a series of slots formed therein, and wherein said first sheet guide means comprises a plurality of movable, flexible metal fingers that extend through said slots to engage and to be flexed by said first roll surface, said fingers being moved to a location below said paper guide plate upon movement of said handle means to said second stable position.

23. The roll fuser of claim 20 including third sheet guide means mounted on the upstream side of said first sheet guide means;

fourth sheet guide means located on the upstream side of said second sheet guide means;

said third and fourth sheet guide means normally being in a closely spaced position, to form a second closed sheet guide path which is operable to guide the leading edge of a sheet away from the downstream side of said first sheet guide path; and said manually operable handle means being connected to said third and fourth sheet guide means such that in said first stable position of said handle means said third and fourth sheet guide means are in said closely spaced position, and in said second stable position of said handle means said third and fourth sheet guide means are spaced apart to facilitate sheet jam clearance from said second sheet guide path.

24. The roll fuser of claim 23 including first stop means cooperating with said handle means and operable to limit said close spacing of said first and second sheet guide means, and said third and fourth sheet guide means; and second stop means cooperating with said handle means and operable to limit said return spaced apart movement of said first and second sheet guide means, and said third and fourth sheet guide means.

* * * * *